US008936110B2

(12) United States Patent
Adam

(10) Patent No.: US 8,936,110 B2
(45) Date of Patent: Jan. 20, 2015

(54) UNDER REAMER

(75) Inventor: Mark Adam, Aberdeen (GB)

(73) Assignee: NOV Downhole Eurasia Limited, Stonehouse (GB)

( * ) Notice: Subject to any disclaimer, the term of this patent is extended or adjusted under 35 U.S.C. 154(b) by 380 days.

(21) Appl. No.: 13/263,600

(22) PCT Filed: Apr. 9, 2010

(86) PCT No.: PCT/GB2010/000728

§ 371 (c)(1),
(2), (4) Date: Oct. 7, 2011

(87) PCT Pub. No.: WO2010/116152

PCT Pub. Date: Oct. 14, 2010

(65) Prior Publication Data

US 2012/0055714 A1 Mar. 8, 2012

(30) Foreign Application Priority Data

Apr. 9, 2009 (GB) ..... 0906211.8

(51) Int. Cl.
*E21B 10/32* (2006.01)
*E21B 41/00* (2006.01)

(52) U.S. Cl.
CPC ..... *E21B 10/322* (2013.01); *E21B 41/00* (2013.01)
USPC ..... 175/57; 175/269

(58) Field of Classification Search
CPC ..... E21B 10/322; E21B 10/345
USPC ..... 175/268, 269, 291, 57
See application file for complete search history.

(56) References Cited

U.S. PATENT DOCUMENTS

| | | | |
|---|---|---|---|
| 904,344 | A | 11/1908 | Mapes |
| 1,302,058 | A | 4/1919 | Layne et al. |
| 1,391,626 | A | 9/1921 | Oilthorpe et al. |
| 1,485,642 | A | 4/1922 | Stone |
| 1,810,201 | A | 12/1928 | Campbell |
| 1,902,174 | A | 3/1933 | Lewis et al. |
| 2,122,863 | A | 7/1938 | Howard et al. |
| 2,179,010 | A | 11/1939 | Creighton et al. |
| 2,890,022 | A | 6/1959 | Brown, Jr. |
| 3,376,942 | A | 4/1968 | Van Winkle |

(Continued)

FOREIGN PATENT DOCUMENTS

| | | |
|---|---|---|
| EP | 0301890 | 2/1989 |
| EP | 0301890 A2 | 2/1989 |

(Continued)

OTHER PUBLICATIONS

EPO Search Report and Written Opinion for PCT Patent Application No. PCT/GB2010/000728, mail-dated Dec. 29, 2010, 19 pages.

(Continued)

*Primary Examiner* — William P Neuder
(74) *Attorney, Agent, or Firm* — JL Salazar Law Firm

(57) ABSTRACT

An under-reamer includes a body and extendable cutters mounted on the body. The under-reamer is configured to be cycled between a first configuration in which the cutters are retracted and a second configuration in which the cutters are movable between retracted and extended positions. A control mechanism is provided and is configurable to prevent the under-reamer cycling between the first and second configurations and thus maintains the under-reamer in a selected one of the first and second configurations.

37 Claims, 12 Drawing Sheets

(56) References Cited

U.S. PATENT DOCUMENTS

| | | | | |
|---|---|---|---|---|
| 3,429,387 | A | 2/1969 | Brown | |
| 3,431,989 | A | 3/1969 | Waterman et al. | |
| 3,433,313 | A | 3/1969 | Brown | |
| 4,031,974 | A | 6/1977 | Peterson | |
| 4,889,994 | A | 12/1989 | Brown | |
| 4,915,172 | A | 4/1990 | Donovan et al. | |
| 5,141,062 | A | 8/1992 | Anderson | |
| 5,368,114 | A | 11/1994 | Tandberg et al. | |
| 6,279,670 | B1 | 8/2001 | Eddison et al. | |
| 6,439,318 | B1 | 8/2002 | Eddison et al. | |
| 6,508,317 | B2 | 1/2003 | Eddison et al. | |
| 6,732,817 | B2 | 5/2004 | Dewey et al. | |
| 7,152,702 | B1 | 12/2006 | Bhome et al. | |
| 7,252,163 | B2 * | 8/2007 | Ollerenshaw et al. | 175/269 |
| 7,493,971 | B2 | 2/2009 | Nevlud et al. | |
| 7,584,811 | B2 | 9/2009 | Fanuel et al. | |
| 7,658,241 | B2 | 2/2010 | Lassole et al. | |
| 7,681,666 | B2 | 3/2010 | Radford et al. | |
| 7,703,553 | B2 * | 4/2010 | Eddison et al. | 175/269 |
| 7,757,787 | B2 | 7/2010 | Mackay et al. | |
| 7,823,663 | B2 | 11/2010 | Eddison | |
| 8,540,035 | B2 * | 9/2013 | Xu et al. | 175/268 |
| 8,555,983 | B2 * | 10/2013 | Palacios | 166/373 |
| 2003/0111236 | A1 | 6/2003 | Serafin | |
| 2006/0144623 | A1 * | 7/2006 | Ollerensaw et al. | 175/269 |
| 2007/0089912 | A1 * | 4/2007 | Eddison et al. | 175/269 |
| 2007/0102201 | A1 | 5/2007 | Savignat | |
| 2007/0240906 | A1 | 10/2007 | Hill | |
| 2008/0070038 | A1 | 3/2008 | Vincent et al. | |
| 2008/0257608 | A1 | 10/2008 | Fanuel et al. | |
| 2010/0116556 | A1 | 5/2010 | Buske | |
| 2013/0133949 | A1 * | 5/2013 | Xu et al. | 175/40 |

FOREIGN PATENT DOCUMENTS

| | | |
|---|---|---|
| FR | 1249499 | 12/1960 |
| GB | 2147033 | 5/1985 |
| GB | 2386387 | 9/2003 |
| GB | 2401284 | 11/2004 |
| GB | 2411419 | 8/2005 |
| GB | 2434389 | 7/2007 |
| GB | 2446294 | 8/2008 |
| GB | 2450433 | 12/2008 |
| NO | 330479 | 4/2011 |
| WO | 02064939 | 8/2002 |
| WO | 03008754 | 1/2003 |
| WO | 2004048744 | 6/2004 |
| WO | 2004097163 | 11/2004 |
| WO | 2004104360 | 12/2004 |
| WO | 2005103435 | 11/2005 |
| WO | 2007017651 | 2/2007 |
| WO | 2007017651 A1 | 2/2007 |
| WO | 2008070052 | 6/2008 |

OTHER PUBLICATIONS

IADC/SPE Drilling Conference, "Wellbore Enlargement for a Deepwater Casing Program: Case Study and Developments, Abstract", Mar. 2-4, 2004, Dallas, TX pp. 1-11.

PCT Search Report and Written Opinion for counterpart PCT Application No. PCT/GB2010/000728 dated Dec. 29, 2010, pp. 1-19.

Amendment dated May 31, 2012 for counterpart EP Application No. 10717716.4, pp. 1-18.

EP Office Action dated Aug. 7, 2012 for counterpart EP Application No. 10717716.4, pp. 1-3.

Response to EP Office Action dated Oct. 12, 2012 for counterpart EP Application No. 10717716.4, pp. 1-2.

EP Search Report dated Nov. 14, 2012 for counterpart EP Application No. 1217033.4, pp. 1-7.

Response to Extended European Search Report for European Patent Application No. 12170333.4 dated Jun. 11, 2013, 36 pages.

Extended European Search Report for European Patent Application No. 12170333.4 dated Nov. 7, 2012, 5 pages.

* cited by examiner

UNDER REAMER

CROSS REFERENCE TO RELATED APPLICATIONS

This application claims priority to PCT Patent Application No. PCT/GB2010/000728 filed on Apr. 9, 2010.

FIELD OF THE INVENTION

This invention relates to an under-reamer, and to a method of operating an under-reamer. Aspects of the invention also relate to downhole tools in general, and methods of operating fluid actuated downhole tools.

BACKGROUND OF THE INVENTION

In the oil and gas exploration and production industry, bores are drilled from surface to access sub-surface hydrocarbon-bearing formations. The drilled bores are lined with tubing, known as casing or liner, and cement is injected into the annulus between the casing and the surrounding bore wall. Typically, the bore is drilled in sections, and after drilling a section, that section is lined with casing. Following cementing of the casing, the next section of bore is drilled. However, as the drill bit utilized to drill the next section must pass through the existing casing, the drill bit will, of necessity, be of smaller diameter than the drill bit used to drill the previous section. It is often considered desirable to enlarge the bore diameter below a section of casing beyond the drill bit diameter, and this is normally achieved by means of an under-reamer mounted above the drill bit.

Particularly in offshore and deepwater wells, getting the largest casing size possible into the ground is critical to ensure target depth (TD) can be reached with the largest bit size possible, thus maximizing production and facilitating access. Under-reaming the pilot bore drilled by the fixed diameter drill bit enables casing sizes to be maximized by providing sufficient open hole clearance to allow the maximum pass through casing size to be selected. Since a newly drilled wellbore can quickly become unstable, for example due to formation creep/swelling, it is also important to set casing as early as possible. Operators are therefore focused upon minimizing the time delay between reaching target depth (TD) and setting casing.

When a bore section has been drilled and under-reamed it is necessary to circulate the well bore clean, that is circulate a fluid such as drilling mud or brine in the bore to remove drill cuttings and to ensure the casing is not obstructed when run in hole. High circulation flow rates are often utilized to speed up the cleaning process. Also, as the drill string is pulled from the hole, the bottom hole assembly (BHA) will be rotated to stir up cutting beds for circulation of the cuttings to the surface. When a hydraulically activated under-reamer is present in the BHA it is often the case that the under-reamer cutters will extend into a hole opening position when high circulation rates are used. This can result in further cuttings generation (as the BHA is effectively back-reamed up through the wellbore) and additional hole cleaning time.

There have been a number of proposals for under-reamers in which it is possible to lock the under-reamer in the retracted (pilot size) configuration when a section has been drilled and under-reamed to minimize the time required to pull out of hole and subsequently run casing. An example of such an arrangement is described in applicant's International patent application, Publication No. WO2007/017651 A1.

SUMMARY OF THE INVENTION

According to the present invention there is provided an under-reamer comprising: a body; a plurality of extendable cutters mounted on the body, the under-reamer configured to be cycled between a first configuration in which the cutters are retracted and a second configuration in which the cutters are movable between retracted and extended positions; and a control mechanism configurable to prevent cycling between the first and second configurations and thus maintain the under-reamer in a selected one of the first and second configurations.

According to another aspect of the present invention there is provided a downhole bore treating method comprising: running an under-reamer comprising extendable cutters into a bore; cycling the under-reamer between a first configuration in which the cutters are retracted and a second configuration in which the cutters are movable between retracted and extended positions; maintaining the under-reamer in a selected one of the first and second configurations by preventing cycling of the under-reamer between the first and second configurations, and pulling the under-reamer from the bore.

Thus, in use, the under-reamer may be maintained in a selected configuration, including the second configuration, and prevented from changing configuration. This contrasts with prior proposals in which under-reamers or similar tools cycle between configurations with, for example, variations in fluid flow through the tool. Thus, switching mud pumps on or off for reasons unrelated to the operation of the under-reamer may result in a change in configuration of the under-reamer, requiring the under-reamer to be re-configured before an operation may be restarted or commenced. Certain existing proposals allow for the under-reamer to be initially locked in a configuration with the cutters retracted, or for the cutters to be locked in a retracted position following an under-reaming operation. However, it is not possible to lock the under-reamers in the second configuration, with the cutters movable between the retracted and extended positions, or to lock the cutters in the retracted position following an under-reaming operation and subsequently return the under-reamer to a configuration in which the cutters are extendable.

The under-reamer may be mounted on a drill string above a drill bit or other pilot cutter.

The under-reamer may be run into the bore while being maintained in the first configuration, with the control mechanism set to retain the cutters in the retracted configuration, or alternatively the under-reamer may be run in with the control mechanism set to retain the under-reamer in the second configuration, such that the cutters are extendable.

The under-reamer may be pulled from the bore while being maintained in the first configuration, and fluid may be circulated through the string while the under-reamer is being pulled from the bore.

The body may define a through passage, and fluid may be pumped through the body and into a section of drill string below the body.

The under-reamer may be fluid actuated, and the cutters may be configured to be actuated by pressure acting across a piston.

The control mechanism may be actuated by any appropriate means. The mechanism may be fluid pressure actuated. In the first configuration fluid pressure acting on the mechanism may cause the mechanism to retain the cutters in the retracted configuration. The control mechanism may comprise a control piston.

Where a piston is utilized to actuate one of the cutters and the control mechanism, one side of the piston may be exposed to an internal body pressure and the other side of the piston may be exposed to an external body pressure. Alternatively, or in addition, where fluid may be pumped through the body, one side of the piston may be exposed to an internal upstream pressure and the other side of the piston may be exposed to an internal downstream pressure. The piston may be annular.

A control piston may be configured to generate a retaining force acting in one direction and a cutter-actuating piston may be configured to generate a cutter extending force acting in an opposite direction. The control piston may define a larger effective area than the cutter-actuating piston such that the control piston generates a larger force for a given pressure differential.

The control mechanism may include an element configurable to restrict or prevent movement of a cutter-actuating element. The control element may be movable relative to the body, for example the element may be axially movable relative to the body. The element may be locatable to maintain the under-reamer in the first configuration and locatable in a second position to maintain the under-reamer is in the second configuration.

The control element may cooperate with the body via a form of cam arrangement, for example a J-slot arrangement or spline arrangement. Thus, for example, axial movement of the control element relative to the body may cause a cam follower on the control element to advance along a cam track, different portions of the cam track permitting different degrees of relative movement between the control element and the body.

The control mechanism may be configurable to permit a change in the under-reamer configuration. Where the control mechanism is fluid pressure actuated the mechanism may be configurable to respond in a selected manner to applied fluid pressure, for example in a first manner to maintain under-reamer configuration and in a second manner to permit a change of under-reamer configuration. In one embodiment, the control mechanism may include an annular differential piston which is normally configured to be urged in an upwards direction by a differential pressure to maintain under-reamer configuration. However, if a restriction, such as a ball or plug, is located in the piston, an upstream pressure above the ball may be generated to translate the control piston in a downwards direction to permit a change in under-reamer configuration. In other embodiments, the piston may be otherwise configurable to create a flow restriction without requiring a restriction to land in or on the piston. The control piston may move in a downward direction and cycle the control element into an alternate position. The control piston may continue in a downward path until the restriction is ejected. Once the restriction is ejected the control piston may revert back to a normal configuration in which the piston is urged in an upward direction to maintain the under-reamer configuration.

The seat that the restriction lands on may be located within the control piston and may be offset from a central through bore. A through slot opposing the offset seat may extend through the control piston. The through slot may be sized such that the restriction can pass through or along the slot. The control piston outer diameter may be mated within a corresponding body bore. The restriction may land on and be held between the offset seat of the control piston and the internal bore of the mating body. A second larger internal bore may be located axially downhole from the restriction landing position, the larger internal bore being configured such that the restriction will exit the seat when the control piston has traveled sufficiently downwards. The restriction may then travel further downward and land in a retainer mechanism. The control piston may now move upwards, for example under the influence of differential pressure.

The control mechanism may be retained in a configuration-maintaining mode by a retainer member. The retainer member may be configured to retain the configuration-maintaining mode when a reverse pressure, that is a pressure differential acting in the reverse direction to the control piston actuating direction, acts on the control piston. The retainer member may be configured to retract when exposed to actuating pressure. The retainer member may comprise a piston, and one side of the piston may be exposed to internal body pressure and the other side of the piston may be exposed to external body pressure.

Although the invention is described herein primarily with reference to under-reamers, those of skill in the art will recognize that aspects of the invention are applicable to other tools and devices.

According to an alternative aspect of the present invention there is provided a downhole device comprising: a body; a fluid actuated member mounted on the body and being configurable to provide a first device configuration and a second device configuration, the device configured to be cycled between the first and second configurations; and a control mechanism configurable to prevent cycling of the device between the first and second configurations and thus maintain the device in a selected one of the first and second configurations.

According to another aspect of the present invention there is provided a downhole device operating method comprising: running a device comprising a fluid actuated member into a bore; cycling the fluid actuated member between a first configuration and a second configuration; maintaining the member in a selected one of the first and second configurations by preventing cycling between the first and second configurations, and pulling the device from the bore.

According to a further aspect of the present invention there is provided a downhole tool comprising: a body; an actuating piston; a retainer piston operatively associated with the actuating piston and having one face configured to be exposed to external body pressure and another face configured to be exposed to internal body pressure, wherein the retainer piston is configured to generate an actuating piston retaining force when the external body pressure exceeds the internal body pressure.

Many downhole tools and devices feature differential pressure actuating pistons, that is pistons which are actuated by the difference between the internal tool pressure and external tool pressure, sometimes referred to as bore pressure and annulus pressure. Typically, the pistons are configured to be actuated by elevated internal tool pressure. However, there may be occasions when the external pressure exceeds the internal pressure, resulting in the piston being urged in an opposite direction from normal. This may damage the tool or result in an unintended action, for example release of a catch or movement of a cam follower along a cam track. However, with this aspect of the present invention, the retainer piston may serve to retain the actuating piston position or configuration despite the presence of a reverse pressure.

The actuating piston may have one face configured to be exposed to an internal body pressure and another face configured to be exposed to external body pressure, the actuating piston being configured such that when internal body pressure exceeds external body pressure the piston is urged to translate relative to the body.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
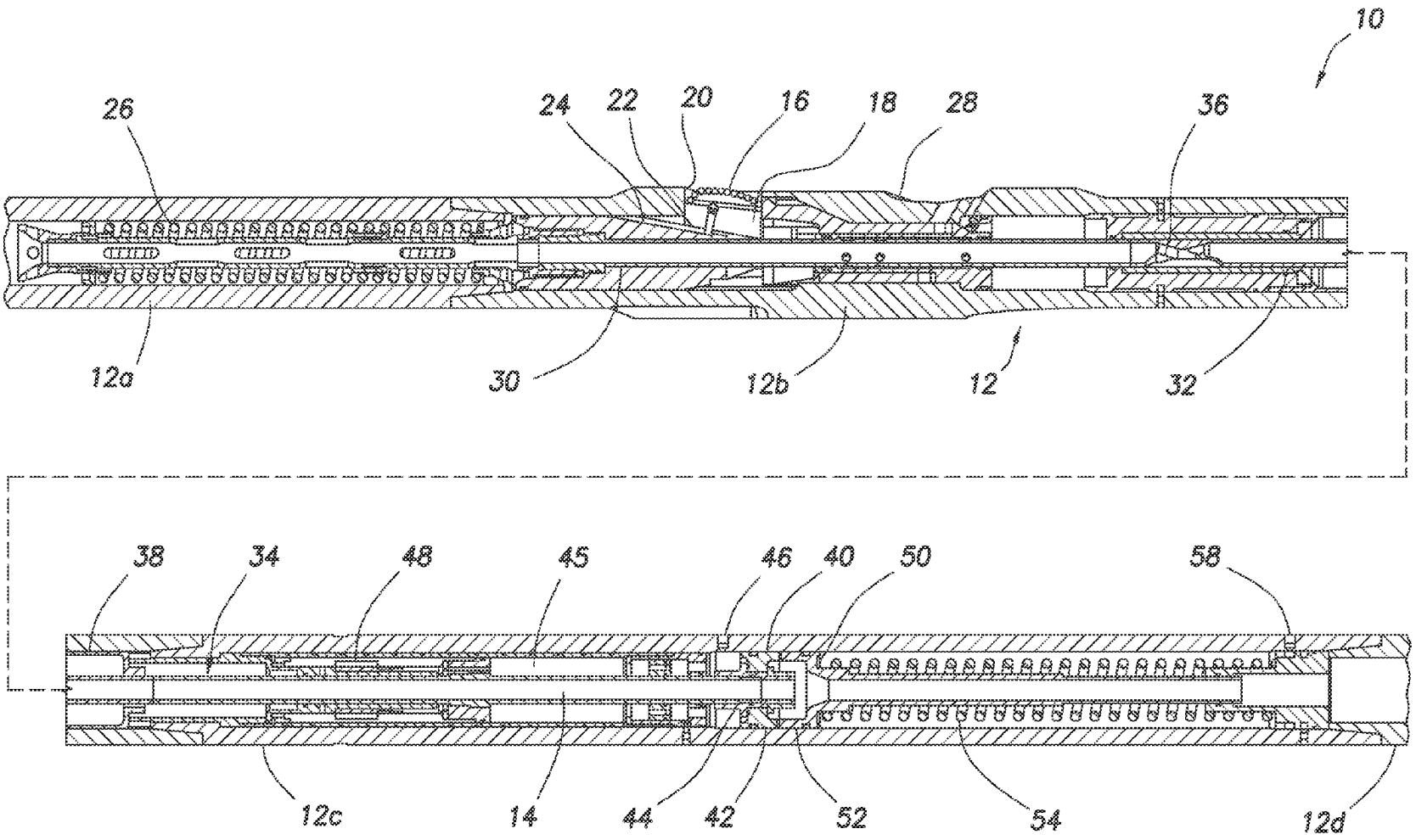
FIG. 1 is a sectional view of an under-reamer in accordance with a preferred embodiment of the present invention shown in an initial configuration.

Reference is first made to FIG. 1 of the drawings which is a sectional view of an under-reamer 10 in accordance with a preferred embodiment of the present invention. The under-reamer 10 is intended for location in a drill string or bottom hole assembly (BHA) with a drill bit (not shown) being provided on the distal end of the string below the under-reamer (to the right in the Figure). Accordingly, the under-reamer 10 comprises a tubular body 12 defining a through bore 14 so that fluid may be pumped from surface, through the string incorporating the under-reamer 10, to the drill bit, the fluid then passing back to surface through the annulus between the drill string and the surrounding bore wall.

The body 12 comprises a number of body sections 12*a*, 12*b*, 12*c*, 12*d* which are coupled to one another using conventional threaded couplings.

The under-reamer 10 features three extendable cutters 16 (only one shown in the drawings). As will be described, when the under-reamer 10 is in a first configuration, the cutters 16 may be selectively maintained or locked in a first, retracted position, as illustrated in FIG. 1, or the under-reamer 10 may be maintained in a second configuration in which the cutters 16 may move between the retracted position and an extended, cutting position (for example, see FIG. 4).

The cutters 16 are formed on cutter blocks 18 located in windows 20 of corresponding shape in the wall of the body 12. Each cutter block 18 features an inclined cam face 22 which cooperates with a surface of a cam piston 24. The cam piston 24 is normally urged to assume the position as illustrated in FIG. 1, with the cutters 16 retracted, by a spring 26. However, when the internal fluid pressure within the under-reamer 10 exceeds the annulus pressure by a sufficient degree, and the under-reamer is in the second configuration, the cam piston 24 may translate axially down through the body 12 to extend the cutters 16.

The lower face of the cutter windows 20 are formed by a secondary cutter retraction assembly 28 which is normally fixed in position. However, if sufficient downward force is applied to the assembly 28, via the cutters 16, the assembly 28 may move downwards independently of the cam piston 24, allowing the cutters 16 to retract even when the cam piston 24 jams in the cutter-extending position. Further details of the retraction assembly 28 are described in United States Patent Application Publication No. US2007/0089912 A1, the disclosure of which is incorporated herein in its entirety.

The cam piston 24 includes a tubular element 30 which extends through the secondary cutter retraction assembly 28 and, in the configuration as illustrated in FIG. 1, a lower face of the element 30 engages an upper face of a tubular element 32 which forms part of a control mechanism 34. The tubular element 32 includes a ball-landing valve 36 and a ball catcher 38 is provided for receiving balls which have landed on the valve 36. As will be described, the control mechanism 34 may be cycled between different configurations by landing a ball in the valve 36 and then utilizing the fluid pressure generated across the ball to move elements of the control mechanism 34 axially downwards. As the control mechanism 34 reaches the downward extent of its travel, the ball is moved into the ball catcher 38.

The lower end of the control mechanism 34 includes a control piston 40. A lower face 42 of the piston 40 is exposed to internal body pressure, while a piston upper face 44 is exposed to annulus pressure; the body cavity 45 above the piston 40 between the tubular element 32 and the body wall is in fluid communication with the annulus via an annulus port 46.

The axial movement of the control mechanism 34 relative to the body 12 is controlled by an indexer 48. The indexer 48 is a three-position, J-slot type mechanism with a "long stroke", reset and "short stroke" sequence. A cam drive causes a spline to be engaged or lined up for the long stroke and then disengaged or misaligned for the short stroke. FIG. 1 illustrates the indexer 48 in the long stroke configuration.

Below the control mechanism 34, the body 12 accommodates a retaining or reverse loading piston 50 which operates to retain the control mechanism 34 in an existing mode. The piston 50 includes a tubular element 52 which extends upwardly, and in the configuration as illustrated in FIG. 1, the upper end of the tubular element 52 engages with a lower surface of the control piston 40. A spring 54 biases the reverse loading piston 50 upwardly, towards the control mechanism 34. An upper face of the piston 50 is exposed to internal body pressure, while a lower face of the piston 50 is exposed to annulus pressure, via an annulus port 58.

In operation, the under-reamer 10 is set up as shown in FIG. 1 for tripping in hole. As described above, the under-reamer 10 will be incorporated in a BHA above the drill bit. As the drill string is made up above the under-reamer 10, and the string is tripped into the hole, there will be periods when the hydrostatic pressure in the annulus surrounding the under-reamer 10 is higher than the internal fluid pressure. In this situation, the higher annulus pressure will urge the reverse loading piston 50 upwards to engage the lower face of the control piston 40. This force, together with the force provided by the reverse loading spring 54, prevents the control piston 40 from moving downwards under the influence of the higher annulus pressure. Such movement would potentially reset the indexer 48, and thus unlock the tool.

Figure 2:
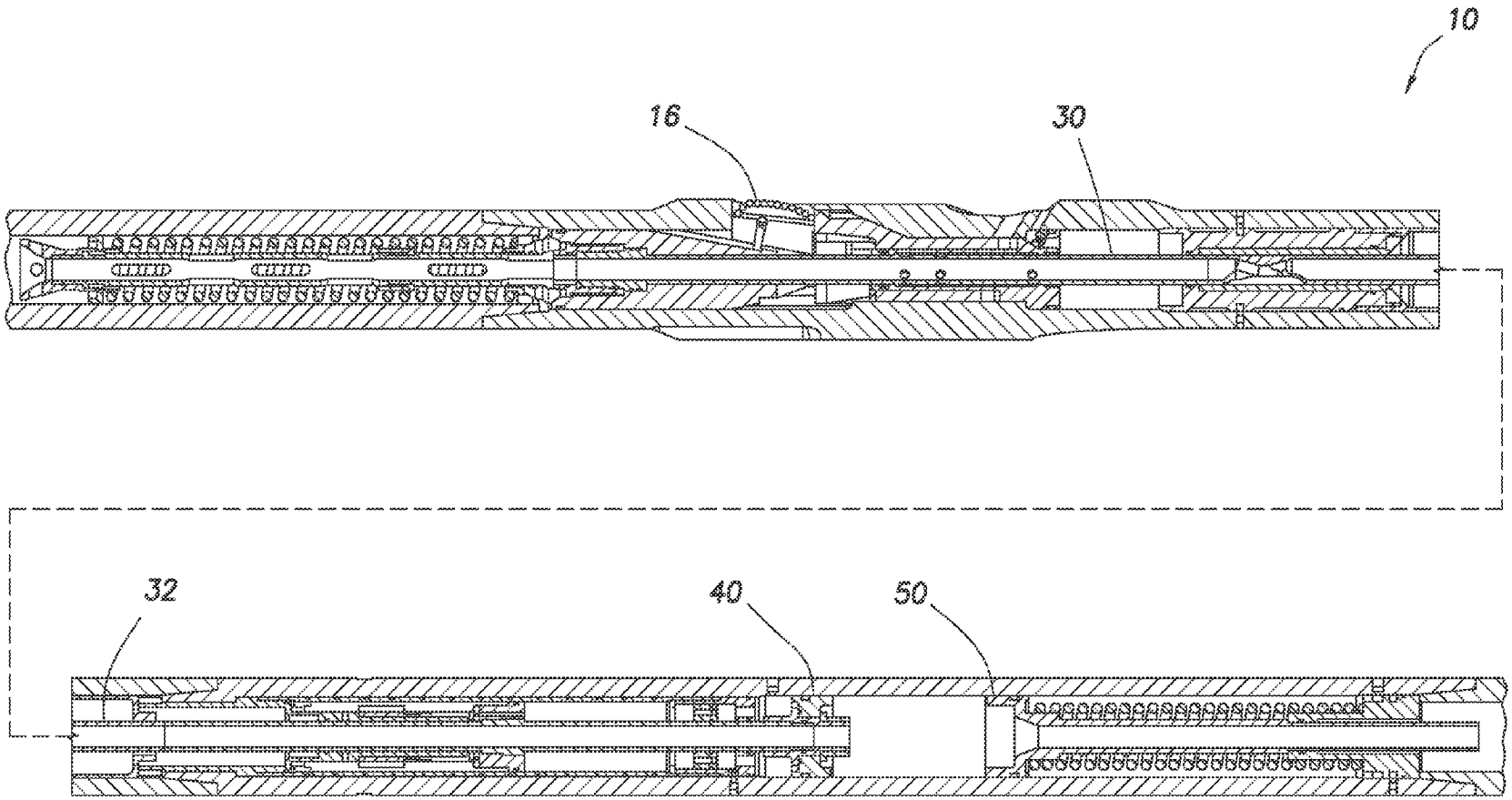
FIGS. 2 to 10 are cross-sectional views of the under-reamer of FIG. 1 shown in different configurations.

Once the drill string has been made up to the appropriate depth, drilling fluid will be circulated through the drill string. This results in the internal pressure rising above the external, annulus pressure. The higher internal pressure causes the reverse loading piston 50 to move away from the control piston 40, as illustrated in FIG. 2 of the drawings.

The elevated internal pressure also causes the control piston 40 to be urged upwardly, and the control mechanism tubular element 32 applies an upward force to the cam piston tubular element 30. The control piston area is greater than the cam piston area such that the control piston 40 generates a greater force. Also, the return spring 26 acts to retract the cam piston 24 such that the cutters 16 are maintained in the retracted position.

Thus, with the under-reamer 10 in this configuration, it is possible for an operator to drill through a shoe track using the drill bit, safe in the knowledge that the cutters 16 will not extend while the under-reamer 10 is located within the casing.

Figure 3:
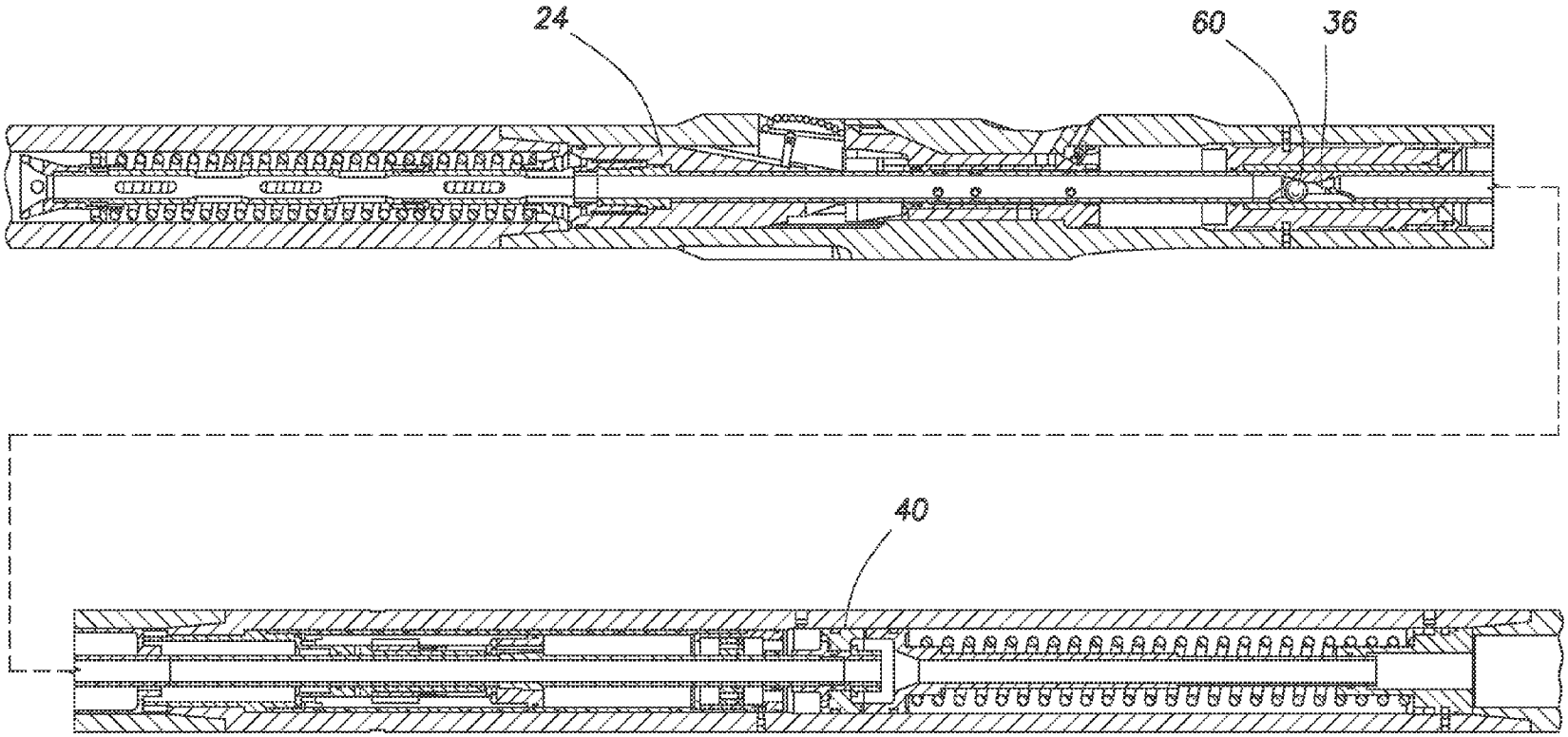

After the shoe track has been drilled and it is desired to actuate the cutters 16, a ball 60 is dropped into the string and landed in the control valve 36, as illustrated in FIG. 3.

Figure 11:
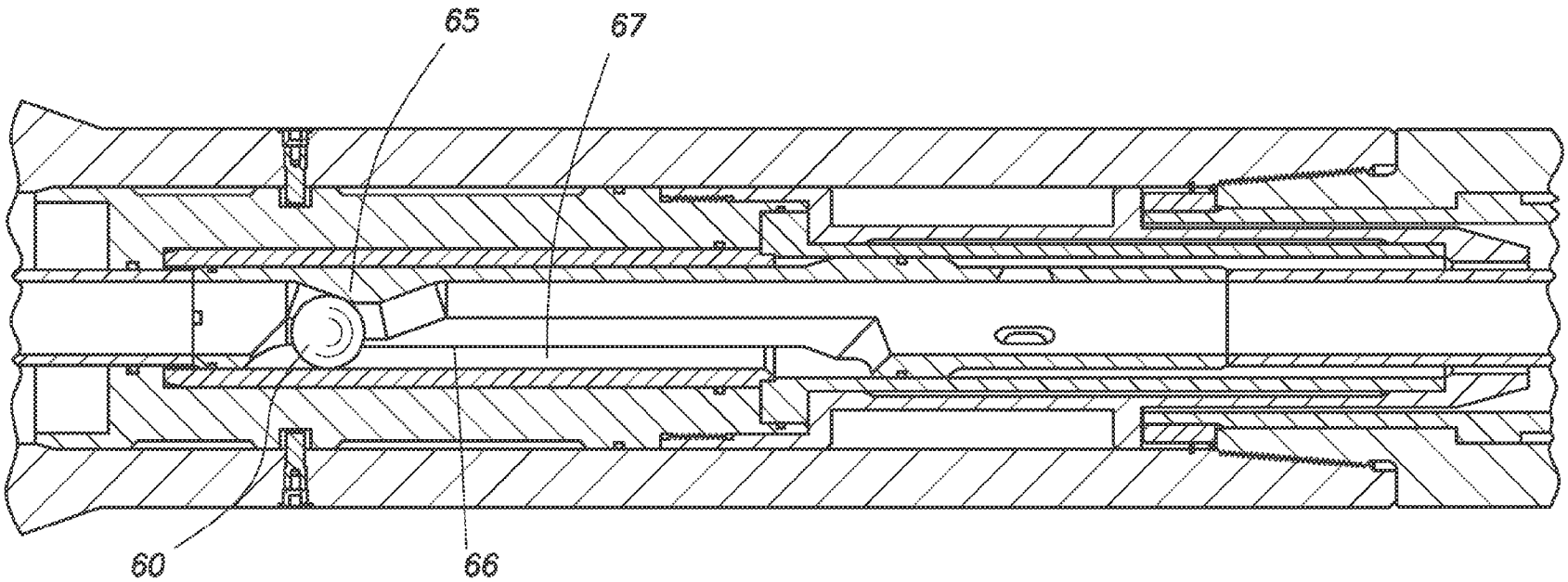
FIGS. 11 and 12 are enlarged sectional views of parts of a control mechanism of the under-reamer of FIG. 1.

The presence of the ball 60 in the valve 36 restricts fluid flow through the under-reamer 10 to the lower section of the string and causes the dominant fluid pressure force to be switched from below the control piston 40 to above the piston 40, such that the control piston 40 is driven downwards. This is assisted by the differential pressure acting on the cam piston 24 which experiences the higher fluid pressure acting above the ball 60. The ball-landing valve 36 can take the form of an offset seat 65 as illustrated in FIG. 11. A through slot 66 is cut through the valve body opposing the seat 65. The valve body outer diameter is mated with a corresponding body internal bore 67. The ball 60 lands on and is held between the offset seat 65 and the internal bore 67.

Figure 4:
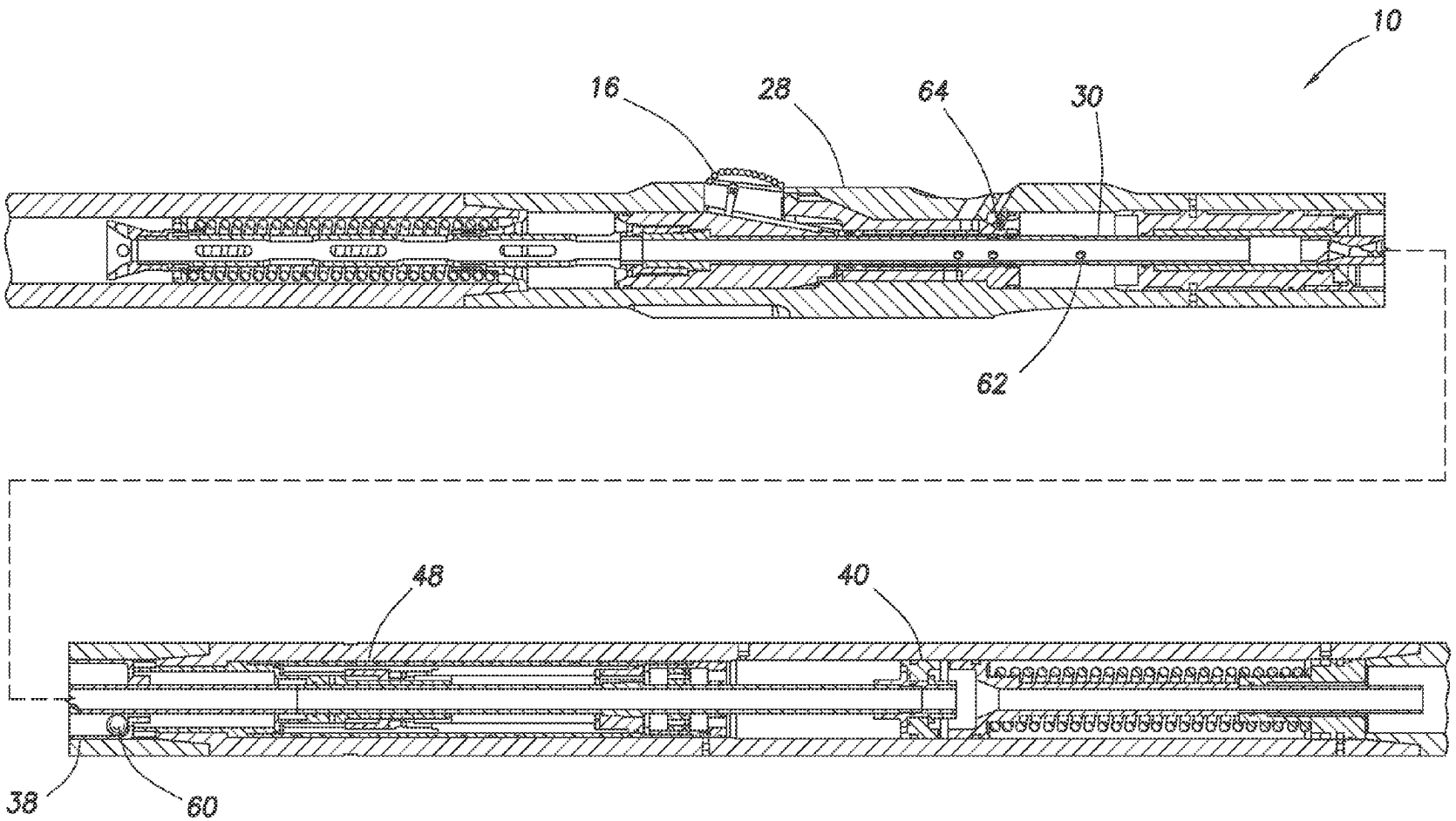
Figure 12:
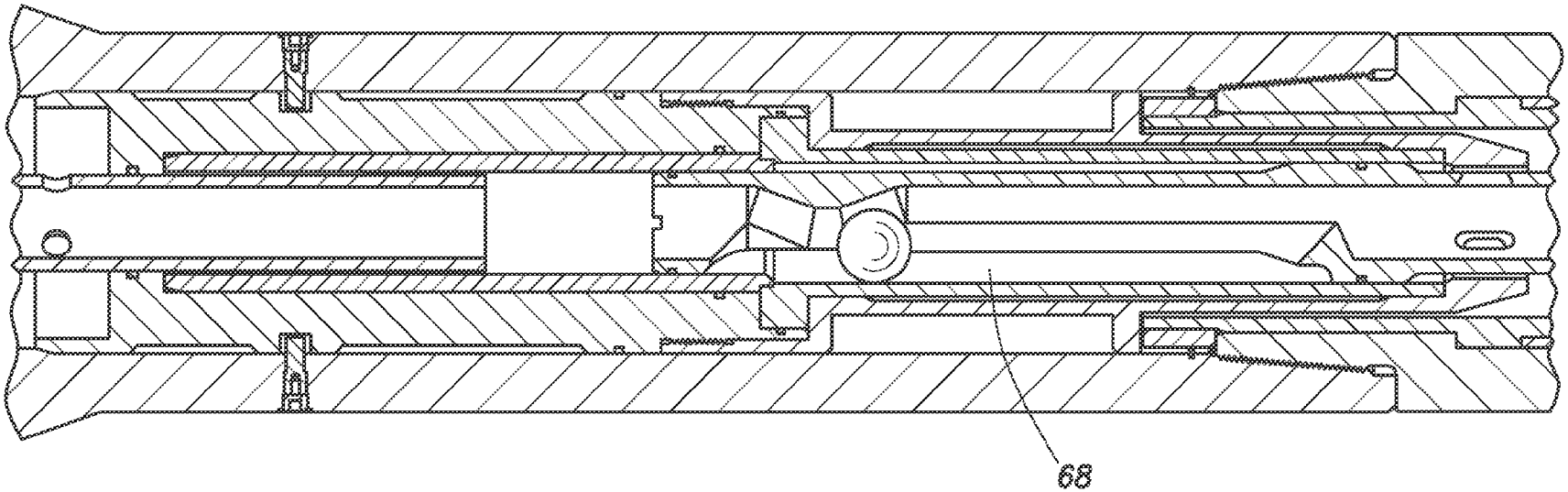

The control piston 40 may thus be driven into a position in which the indexer 48 is reset. The through slot 66 is sized such that the ball 60 can move down the slot 66 and then be ejected though a larger section bore 68, thus bypassing the offset seat 65 and passing into the ball catcher 38, as illustrated in FIGS. 4 and 12.

Figure 5:
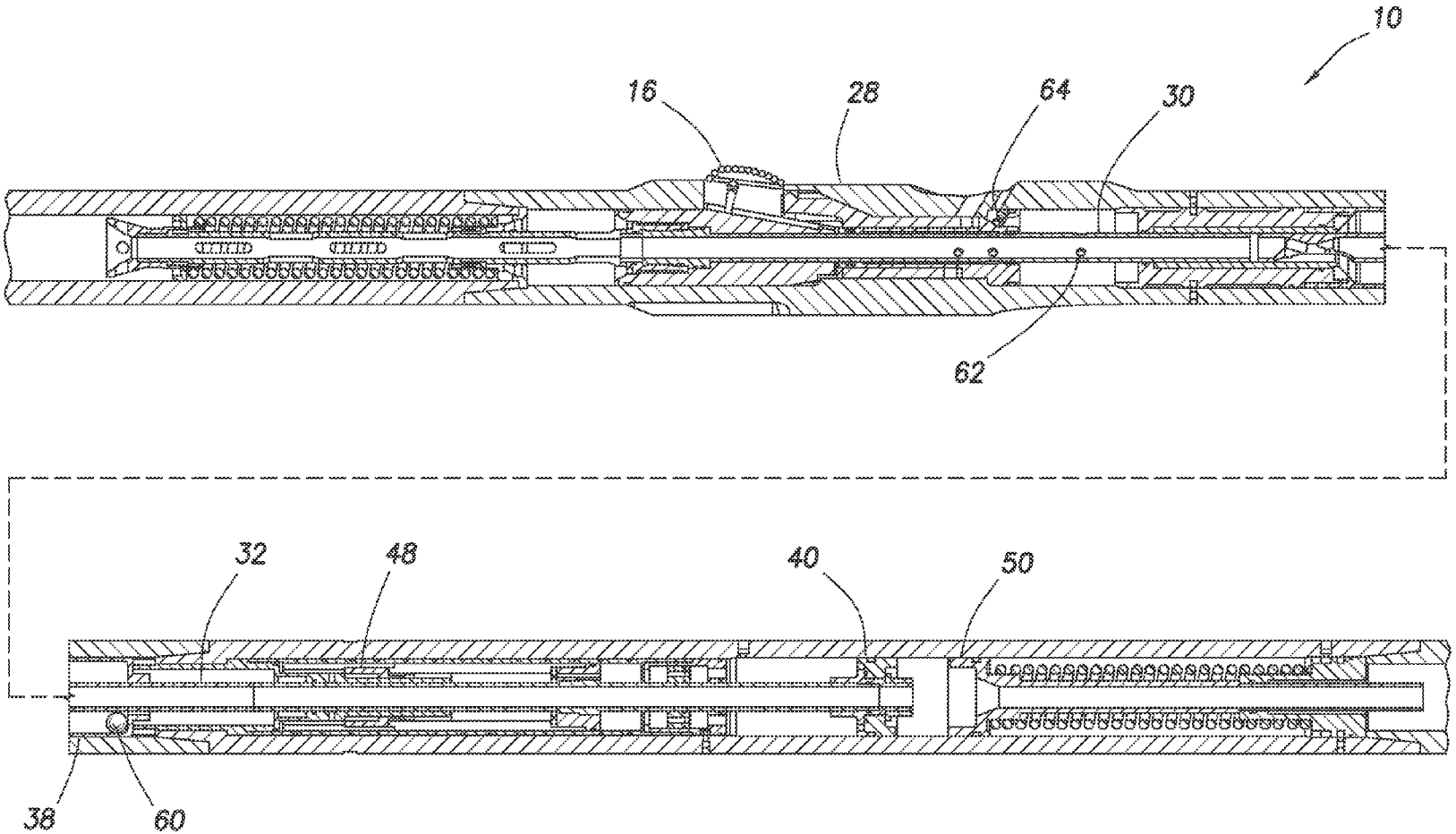

As flow through the under-reamer 10 is re-established following movement of the ball 60 to the ball catcher 38, the reverse pressure piston 50 is driven downwards away from the control piston 40, as illustrated in FIG. 5 of the drawings. Also, the control piston 40 is moved up into the short stroke position, in which the control piston 40 experiences a limited stroke due to splines in the indexer 48 being misaligned. The configuration of the indexer 48 thus stops the control piston 40 and tubular element 32 short of contacting the cam piston tubular element 30, allowing the cam assembly to move between the activated or cutter extended position as illustrated in FIG. 5, and the cutter retracted or deactivated position, depending on whether flow through the string is on or off.

It will be noted from FIG. 5 that in the activated position a port 62 in the cam assembly tubular element 30 is now in fluid communication with a jetting nozzle 64 provided in the secondary cutter retraction assembly 28. This provides a drop in pressure which indicates to the operator that the cutters 16 have been extended.

Figure 6:
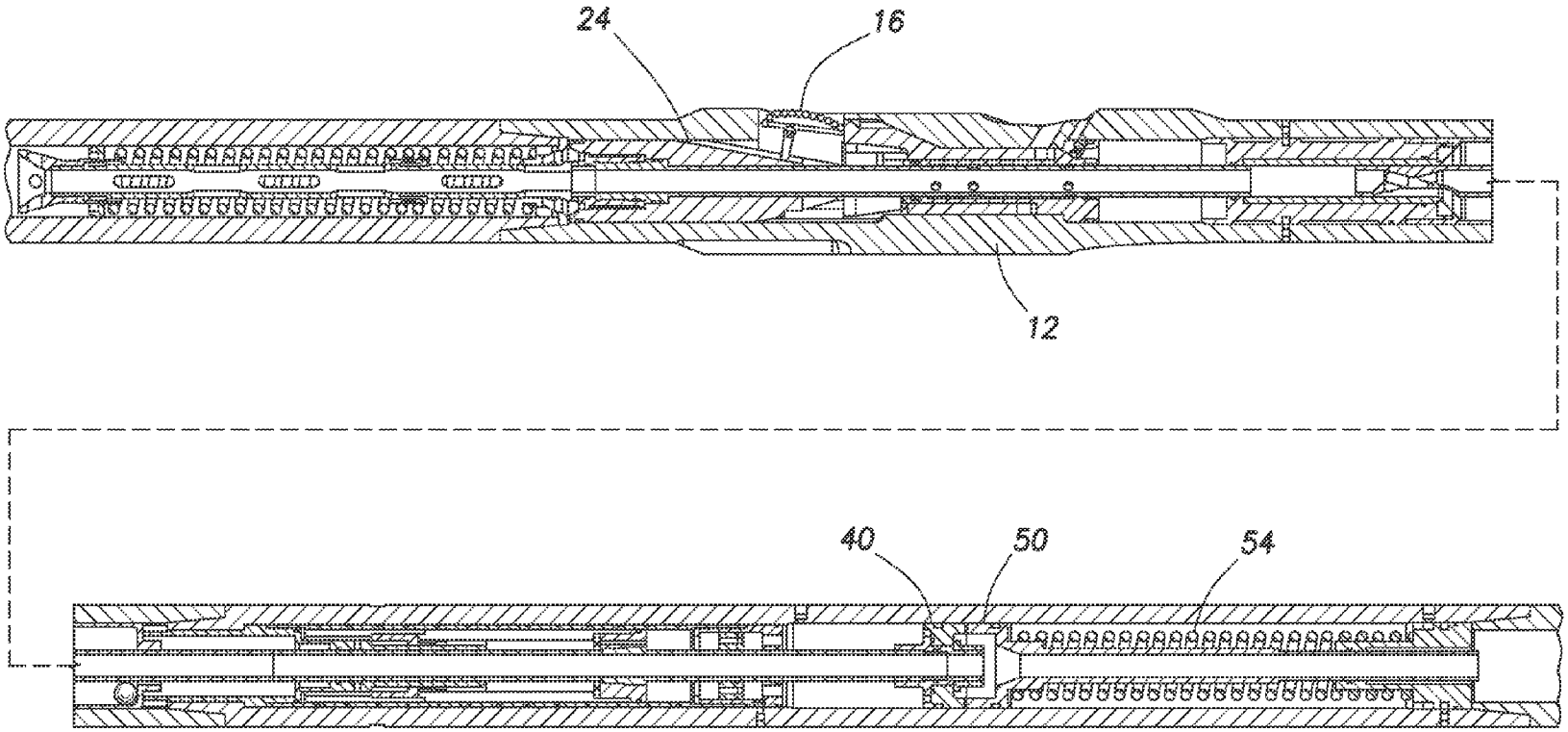

If the surface pumps are switched off, the under-reamer 10 will deactivate, as illustrated in FIG. 6 of the drawings. In particular, the cam assembly return spring 26 will lift the cam piston 24, causing the cutters 16 to retract into the body 12. Also, the reverse loading piston 50 will extend upwards, under the influence of the spring 54, to re-engage the control piston 40 and maintain the piston 40 in the short stroke position. If the pumps were to be turned on again, the tool would activate, and assume the configuration as illustrated in FIG. 5. This remains the case until another ball 60 is dropped into the under-reamer 10.

Thus, the under-reamer 10 may be maintained in the second configuration, in which the cutters 16 are movable between the retracted and extended positions.

Figure 7:
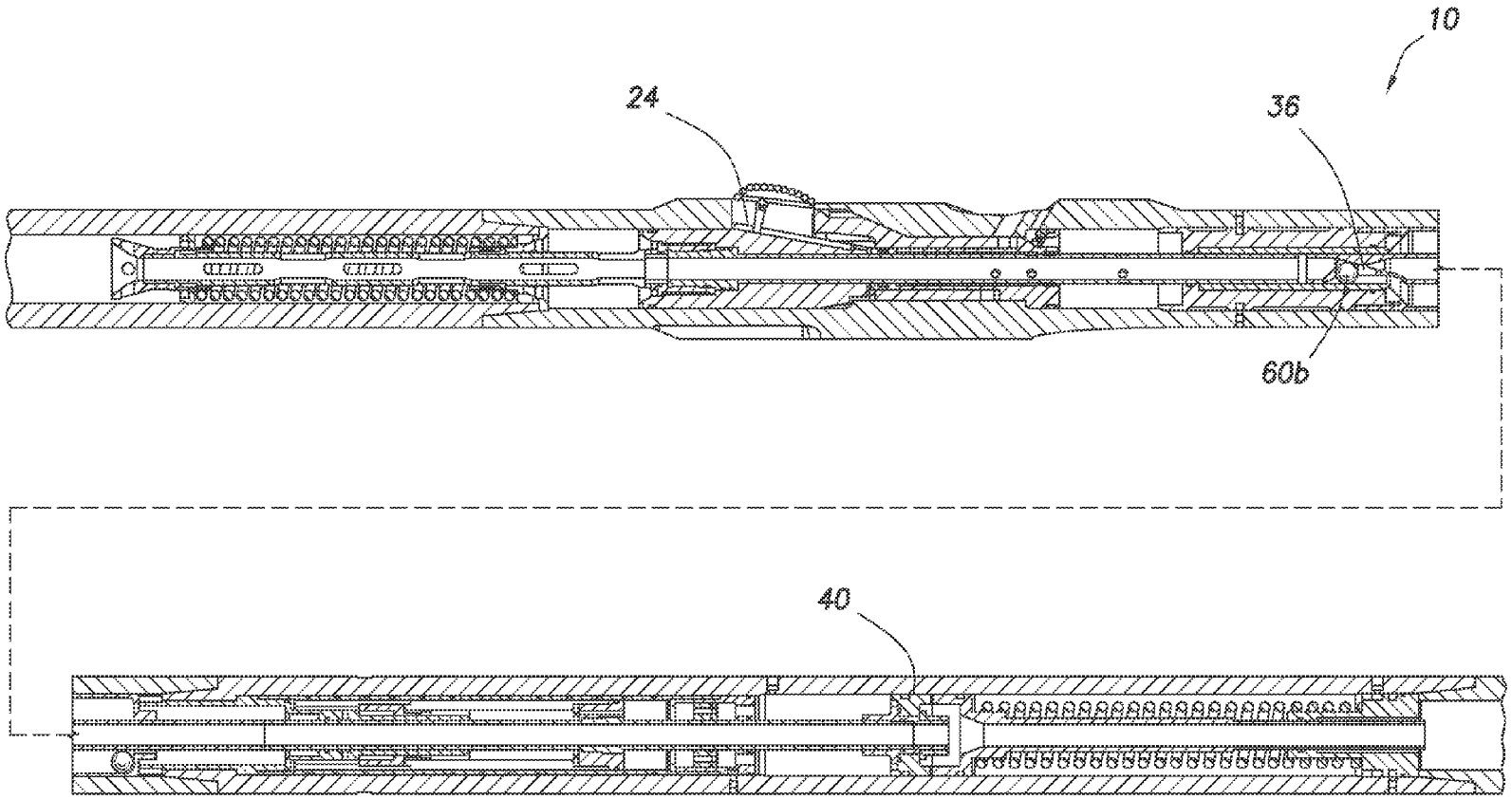
Figure 8:
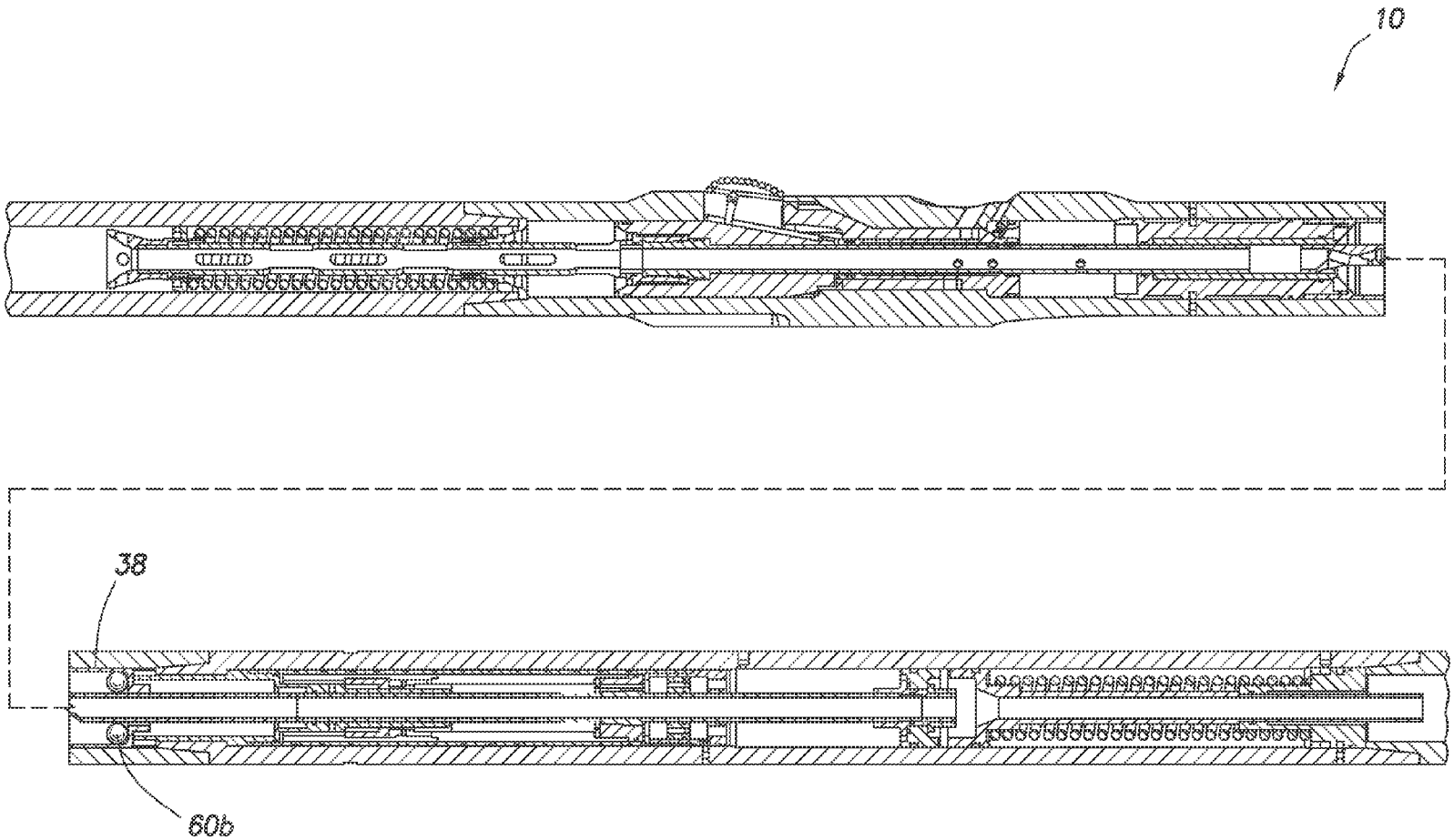

When under-reaming is no longer required, another ball is dropped into the tool, as illustrated in FIG. 7 of the drawings. This Figure shows a second ball 60*b* which has landed in the valve 36. As described above, this causes the dominant fluid pressure force to be switched from below the control piston 40 to above the piston 40 and the control piston 40 will thus be driven downward, assisted by the fluid pressure force acting on the cam piston 24. The control piston 40 may thus be driven into the reset position and the ball 60*b* ejected into the ball catcher 38, as illustrated in FIG. 8 of the drawings.

Figure 9:
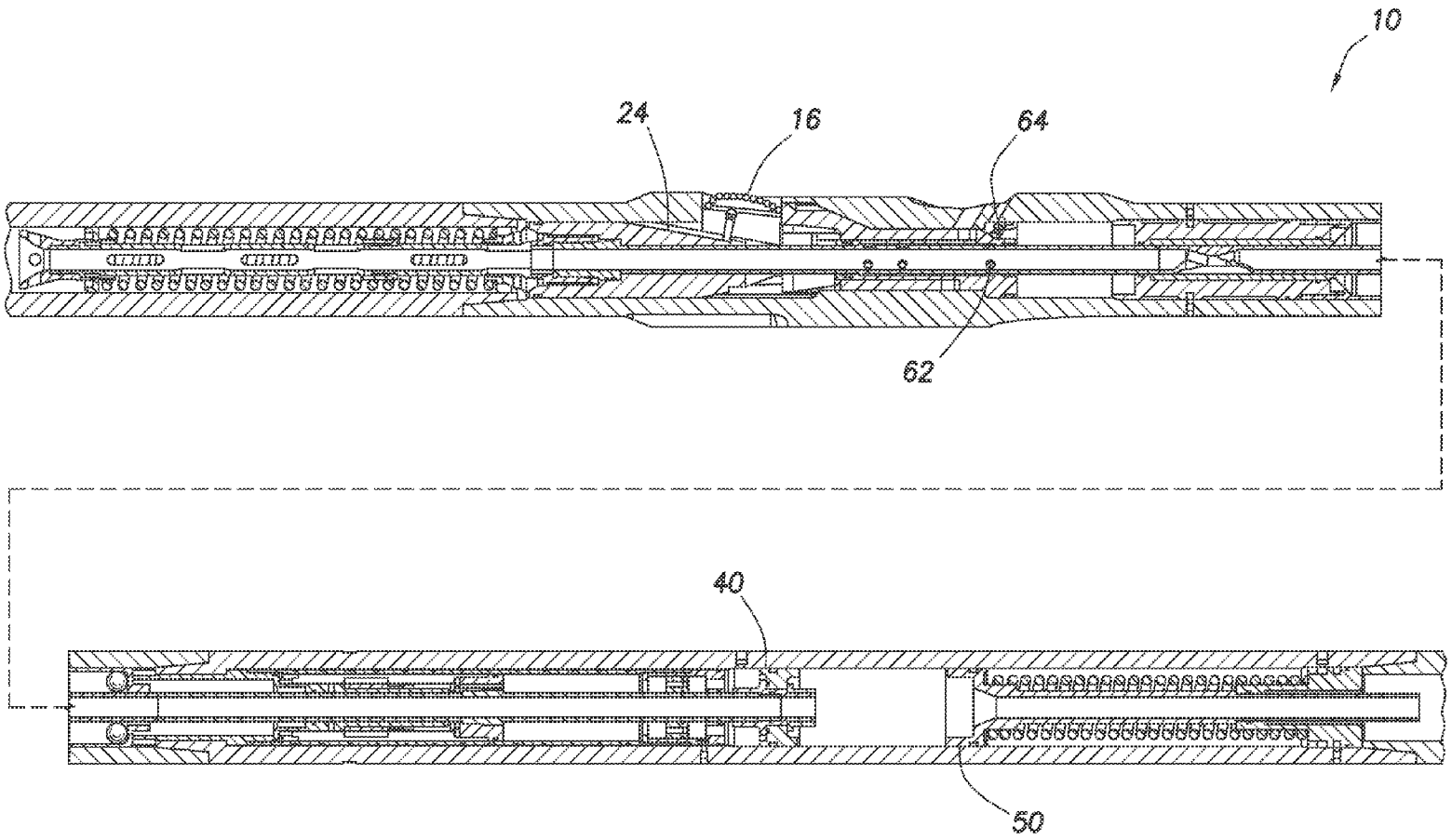

As flow through the under-reamer 10 is re-established, as illustrated in FIG. 9 of the drawings, the reverse pressure piston 50 is driven downwards away from the control piston 40 and the control piston 40 moves up into the long stroke position. In this position the control piston 40 engages the cam assembly and drives the cam piston 24 into the deactivated position, in which the cutters 16 are retracted.

It will be noted from FIG. 9 that the ports 62 are now isolated from the jetting nozzles 64, thus providing an increase in standpipe pressure, which is readily identifiable by the operator, indicating that the tool has been successfully locked closed.

Figure 10:
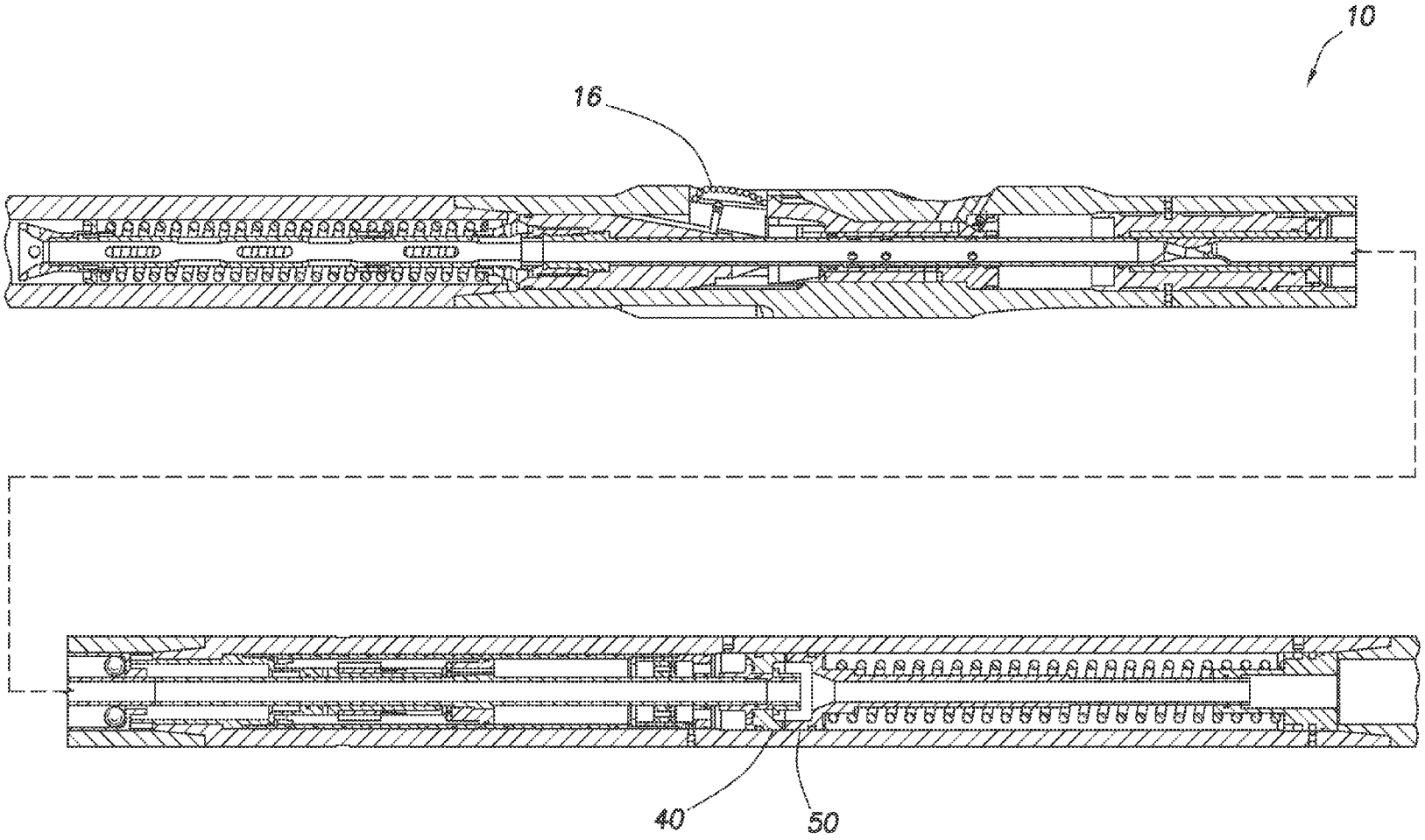

If the pumps are turned off, the under-reamer 10 remains deactivated, as illustrated in FIG. 10 of the drawings. However, it will be noted that the reverse loading piston 50 re-engages with the control piston 40, ensuring that the piston 40 is maintained in the long stroke position. If the pumps are turned on again, the under-reamer 10 remains deactivated, assuming the position as illustrated in FIG. 9. The under-reamer 10 may thus be maintained in the first configuration, with the cutters 16 retracted, until another ball is dropped.

Thus, the under-reamer 10 may be selectively maintained in the first and second configurations. The under-reamer 10 may be locked in the first configuration, with the cutters 16 retracted, for running in, drilling through the shoe track, and also when the section has been completed to minimize the time required to pull out of hole while circulating Furthermore, the under-reamer also permits the operator to selectively move the under-reamer between the first and second configurations. For example, if an operator wishes to ensure that a short, say 200 meter mid-section unstable zone is opened using the under-reamer, the under-reamer 10 may be configured to allow the cutters 16 to extend only when the under-reamer 10 is located within the unstable zone. In many current operations, the entire section would have to be under-reamed, leading to thousands of meters of the section being unnecessarily under-reamed, with the associated added risk and cost.

The provision of an "on demand" under-reamer 10 also provides a useful advantage in contingency situations where unforeseen drilling problems may be solved by under-reaming.

The invention claimed is:

1. A downhole device comprising:

a body;

a fluid actuated member mounted on the body and being configurable to provide a first device configuration and a second device configuration, the downhole device cyclable between the first and second configurations; and a control mechanism comprising an indexer, the control mechanism activatable to selectively index between indexing positions to prevent cycling of the downhole device between the first and second configurations and thus maintain the device in a selected one of the first and second configurations.

2. The downhole device of claim 1, wherein the downhole device comprises an under-reamer;

wherein the fluid actuated member comprises extendable cutters mounted on the body, the under-reamer cyclable between the first configuration in which the cutters are retracted and the second configuration in which the cutters are movable between retracted and extended positions; and wherein the control mechanism selectively prevents cycling between the first and second configurations and thus maintains the under-reamer in a selected one of the first and second configurations.

3. The under-reamer of claim 2, wherein the body defines a through passage, whereby fluid may be pumped through the body and into a section of drill string below the body.

4. The under-reamer of claim 2, wherein the cutters are actuatable by pressure acting across an actuating piston.

5. The under-reamer of claim 2, wherein the control mechanism is fluid pressure actuated.

6. The under-reamer of claim 2, wherein in the first configuration fluid pressure acting on the control mechanism tends to cause the control mechanism to retain the cutters in the retracted position.

7. The under-reamer of claim 2, wherein the control mechanism comprises a control piston.

8. The under-reamer of claim 2, wherein a piston is utilized to actuate at least one of the cutters and the control mechanism, and one side of the piston is exposable to an internal body pressure and another side of the piston is exposable to an external body pressure.

9. The under-reamer of claim 2, wherein a piston actuates at least one of the cutters and the control mechanism, and the body permits fluid to be pumped therethrough, and one side of the piston is exposable to an internal upstream pressure and another side of the piston is exposable to an internal downstream pressure.

10. The under-reamer of claim 2, wherein the control mechanism comprises a control piston to generate a retaining force acting in one direction and the under-reamer comprises a cutter-actuating piston to generate a cutter extending force acting in an opposite direction.

11. The under-reamer of claim 10, wherein the control piston defines a larger effective area than the cutter-actuating piston such that the control piston generates a larger force for a given pressure differential.

12. The under-reamer of claim 10, wherein the control mechanism comprises a control element to at least restrict movement of the cutter-actuating piston.

13. The under-reamer of claim 12, wherein the control element is movable relative to the body.

14. The under-reamer of claim 12, wherein the control element is axially movable relative to the body.

15. The under-reamer of claim 12, wherein the control element is locatable to maintain the under-reamer in the first configuration and locatable in a second position to maintain the under-reamer is in the second configuration.

16. The under-reamer of claim 12, wherein the control element cooperates with the body via a cam arrangement.

17. The under-reamer of claim 12, wherein the control mechanism further comprises an annular differential piston normally urgable in an upwards direction by a differential pressure to maintain an under-reamer configuration to receive a flow restriction permitting generation of an upstream pressure above the restriction to translate the control piston in a downwards direction to permit a change in the under-reamer configuration.

18. The under-reamer of claim 17, wherein downward movement of the control piston cycles the control element into an alternate position.

19. The under-reamer of claim 18, wherein the control piston follows a downward path until the restriction is ejected from the control piston.

20. The under-reamer of claim 19, wherein, following ejection of the restriction, the control piston reverts to a normal configuration in which the control piston is urged in an upward direction to maintain the under-reamer configuration.

21. The under-reamer of claim 17, wherein the control piston comprises a landing seat for the restriction and the landing seat is offset from a central through bore, a through slot opposing the offset landing seat and extending through the control piston, the slot being sized such that the restriction can pass along the slot, the control piston outer diameter being mated within a bore of a corresponding body wherein the restriction may land on and be held between the offset landing seat of the control piston and a bore of the corresponding body, a second larger internal bore being located axially downhole from a landing position of the restriction such that the restriction will exit the offset landing seat when the control piston has travelled sufficiently downwards.

22. The under-reamer of claim 2, wherein the control mechanism permits a change in an under-reamer configuration.

23. The under-reamer of claim 2, wherein the control mechanism is fluid pressure actuated and responds in a selected manner to applied fluid pressure.

24. The under-reamer of claim 2, wherein the control mechanism is configurable in a first manner to maintain an under-reamer configuration and in a second manner to permit a change of the under-reamer configuration.

25. The under-reamer of claim 2, wherein the control mechanism is retainable in a configuration-maintaining mode by a retainer member.

26. The under-reamer of claim 25, wherein the retainer member is to retain the configuration-maintaining mode when a pressure differential acting in a reverse direction to a control mechanism actuating direction acts on the control mechanism.

27. The under-reamer of claim 25, wherein the retainer member is retractable when exposed to actuating pressure.

28. The under-reamer of claim 25, wherein the retainer member comprises a piston, one side of the piston exposable to internal body pressure and the other side of the piston exposable to external body pressure.

29. A downhole device operating method comprising:

running a device into a bore, the device comprising a body, a fluid actuated member, and a control mechanism, the control mechanism comprising an indexer;

cycling the fluid actuated member between a first configuration and a second configuration;

maintaining the fluid actuated member in a selected one of the first and second configurations by preventing cycling between the first and second configurations using a selected indexing position of the indexer; and pulling the device from the bore.

30. The method of claim 29, wherein the fluid actuated member comprises an under-reamer comprising extendable cutters;

wherein the cycling comprises cycling the under-reamer between the first configuration in which the cutters are retracted and the second configuration in which the cutters are movable between retracted and extended positions; and wherein the maintaining comprises maintaining the under-reamer in a selected one of first and second configurations by preventing cycling of the under-reamer between the first and second configurations.

31. The method of claim 30, comprising mounting the under-reamer on a drill string above a pilot cutter.

32. The method of claim 30, comprising running the under-reamer into the bore in the first configuration.

33. The method of claim 30, comprising running the under-reamer to the bore in the second configuration.

34. The method of claim 30, comprising pulling the under-reamer from the bore in the first configuration.

35. The method of claim 30, comprising mounting the under-reamer on a string and circulating fluid through the string while the under-reamer is being pulled from the bore.

36. A downhole tool comprising:

a body;

an actuating piston; and a retainer piston operatively associated with the actuating piston, the retainer piston having one face exposable to external body pressure and another face exposable to internal body pressure;

wherein the retainer piston generates an actuating piston retaining force when the external body pressure exceeds the internal body pressure.

37. The tool of claim 36, wherein the actuating piston has one face exposable to the internal body pressure and another face exposable to the external body pressure, wherein, when the internal body pressure exceeds the external body pressure, the actuating piston is urged to translate relative to the body.

* * * * *